US007617928B1

(12) United States Patent
Murphy

(10) Patent No.: US 7,617,928 B1
(45) Date of Patent: Nov. 17, 2009

(54) CARD HOLDER AND DISPENSING DEVICE

(76) Inventor: Gerald P. Murphy, 24902 Sunstar La., Dana Point, CA (US) 92629

( * ) Notice: Subject to any disclaimer, the term of this patent is extended or adjusted under 35 U.S.C. 154(b) by 620 days.

(21) Appl. No.: 11/338,249

(22) Filed: Jan. 24, 2006

(51) Int. Cl.
*A45C 11/18* (2006.01)
*B65D 83/12* (2006.01)

(52) U.S. Cl. ..... 206/39.5; 206/39; 206/449

(58) Field of Classification Search ..... 206/39.5, 206/38, 39, 449, 215, 425, 451, 480, 477, 206/39.6; 40/654.01, 649; D3/247
See application file for complete search history.

(56) References Cited

U.S. PATENT DOCUMENTS

| | | | | | |
|---|---|---|---|---|---|
| 1,415,276 | A | | 5/1922 | Terner | |
| D256,852 | S | | 9/1980 | McGahee | |
| 4,496,058 | A | * | 1/1985 | Harris et al. | 40/308 |
| 4,674,628 | A | * | 6/1987 | Prinsloo et al. | 206/38.1 |
| 5,020,255 | A | * | 6/1991 | Rodel | 40/654 |
| D317,983 | S | | 7/1991 | Gilbreath | |
| 5,069,333 | A | * | 12/1991 | Chen | 206/39.5 |
| 5,938,010 | A | * | 8/1999 | Osterbye | 206/38 |
| 6,105,294 | A | * | 8/2000 | Goodfellow | 40/654.01 |
| 6,427,836 | B1 | | 8/2002 | Bolanos | |
| 6,427,837 | B1 | * | 8/2002 | Shields | 206/449 |
| 6,823,910 | B1 | * | 11/2004 | Elnekaveh | 150/147 |

* cited by examiner

*Primary Examiner*—Mickey Yu
*Assistant Examiner*—Steven A. Reynolds
(74) *Attorney, Agent, or Firm*—W. Patrick Quast

(57) ABSTRACT

A card holder and dispensing device comprises a rectangularly shaped frame member including upper, lower and side perimeter segments. These form an enclosure into which is placed a plurality of, typically, plastic cards. The upper and lower segments form an open area which is less than the surface area of the cards so that they can't be removed through these openings. A card retention tab extends from one of the side perimeter segments beyond the enclosure formed by the frame member. This restrains movement of the cards out of the card insertion opening.

One of the top frame segments includes a tab section which is typically biased downward into the enclosure volume to exert a downward force on the stored cards. This permits the user to move one or more of the cards partially out of the enclosure until the desired card is reached and assists in the removal of the desired card. The tab section can be variously shaped, sized and contoured to accommodate printed indicia.

3 Claims, 5 Drawing Sheets

CARD HOLDER AND DISPENSING DEVICE

FIELD OF THE INVENTION

The present invention relates generally to an article protecting device and more particularly to a card holder including a manual dispensing capability, used most suitably as a plastic card holder and dispensing device.

BACKGROUND OF THE INVENTION

Most individuals have more than one credit card in their possession as well as similarly constructed plastic cards as, for example, prepaid credit cards, prepaid casino gaming cards, a driver's license, store discount or premium cards, library cards, medical insurance cards, etc. These typically have a rigid or semi-rigid plastic finish and measure approximately 2⅛ inches by 3⅜ inches.

People will carry them in slotted compartments in their wallet or purse or within one or more protected sections, again within the wallet or purse.

A separate card holder can be employed in the wallet or purse to be used to hold these plastic cards and/or business cards.

One of the difficulties with either of these is that it requires two hands to search through the wallet or card holder so as to eventually retrieve the one card desired.

It would be convenient to have a plastic card holder which can conveniently store a number of these cards and likewise provide the convenience of being easily manipulated, using one hand, if necessary, so as to remove the desired card from the contained grouping.

Further, it would also be advantageous if the holder lent itself to being cheaply made. It would be a further benefit, if the card holder included structure which functionally aided the retention of a plurality of cards while facilitating their removal, one at a time, while providing ancillary benefits such as affording an area onto which promotional or advertising indicia can be placed.

U.S. Design Pat. D 256,852 depicts one form of a credit card holder which appears to have one or more of the advantages sought to be achieved by the present design.

U.S. Pat. No. 1,415,276 describes a somewhat complex structure which permits removal of a single business card from a plurality of such cards stacked within the structure.

U.S. Pat. No. 6,427,836 B1 describes an identification card sleeve which includes a tray with an edge bracket surrounding three sides of the periphery of the tray to define a slot. This device claims an extension from the side of the holder, generally semi-circular in shape, and flat to lie in substantially the same plane as the sleeve. The extension is claimed to provide a convenient place for grasping and removing the holder from a wallet. The extension is further claimed to include a plurality of raised ribs which facilitate the gripping of the extension by the fingers for easy removal from the wallet.

Design Pat. D 317,983 depicts a credit card clip for holding presumably a plurality of credit cards.

SUMMARY OF THE INVENTION

There is now provided a new and useful card holder and dispensing device which comprises a rectangularly shaped frame member which forms an enclosure volume for a plurality of, typically, plastic cards namely, casino gaming cards, credit cards, store id cards, an operator's license, and the like. The frame member includes a three sided, perimeter segment defining a side frame portion. Two sides of the three sided perimeter segment extend parallel in a same first direction and a third side extends perpendicular to and between the two other sides. The fourth side is an open side through which the cards are posited in the device.

There is an upper frame portion. It includes at least three top segments. At least two of the top segments are contiguous with two respective sides of the perimeter segment. These two top segments form a partial perimeter defining an upper opening, which is coplanar with the two top segments.

There is a lower frame portion. This includes at least two bottom segments. These bottom segments are contiguous with two respective sides of the perimeter segment. The two bottom segments form a partial perimeter for a lower opening. The lower opening is coplanar with the two bottom segments.

One of the top segments includes a tab section. The tab section extends into the upper opening. The tab section has sufficient, upper surface area and contour to permit the placement of predetermined indicia, such as a company logo, on the upper surface area so as to be visually apparent to a user.

The plurality of cards are held for subsequent dispensing from the enclosure, as required, by the user. The upper and lower openings each have a predetermined area less than the known surface area of the cards. Thus the cards cannot be removed from the device in a direction perpendicular to a plane of the upper opening or to a plane of the lower opening.

Further, the tab section is biased downward into the volume of the enclosure, such that it contacts the upper most card stored in the enclosure. The tab section thus exerts a force on the cards stored in said enclosure. The force is sufficient to inhibit the removal of any one of the cards stored in the device without the application of a force directed towards the open end of the perimeter segment.

A further feature includes a card retention tab extending from one of the two parallel sides. This retention tab extends beyond the enclosure formed by the frame member. The card retention tab is configured to restrain the removal of a card from the device without the application of a force applied in the direction of the open end of the perimeter segment.

The tab section can be variously configured to provide the necessary contact area with the top card as well as maximizing the amount of upper surface area for the intended indicia. The embodiment described is trapezoidally shaped with the longer side of the trapezoidally shaped tab section co-extensive with the one of said top segments from which the tab section extends.

DESCRIPTION OF THE PREFERRED EMBODIMENT

Figure 1:
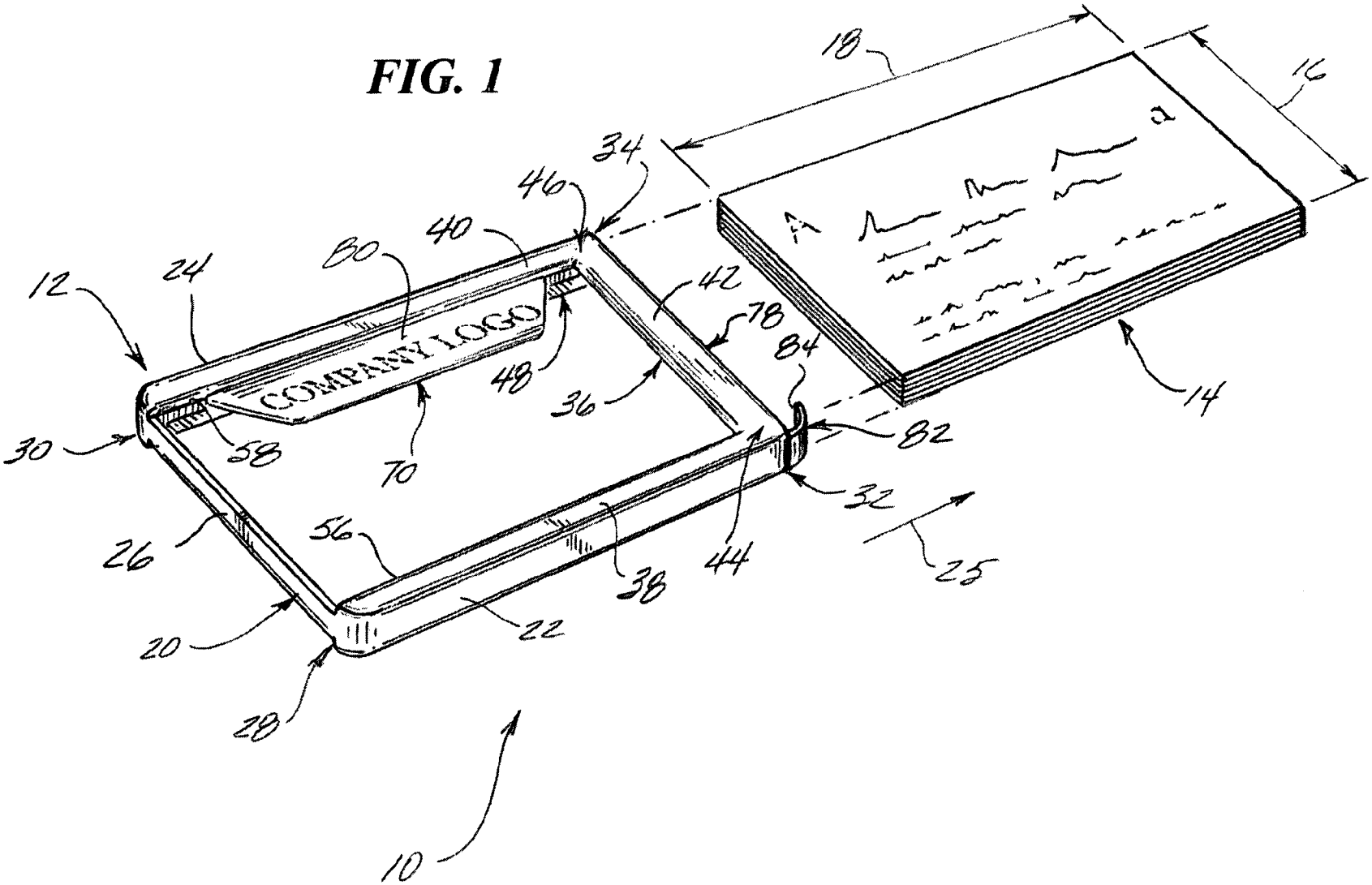
FIG. 1 is a perspective view of the relationship between the device of the present invention and the cards to be stored therein, prior to their insertion.

FIG. 1 depicts in perspective form, the card holder and dispensing device 10 of the present invention. It comprises a frame member 12. The frame member, generally, defines an enclosed volume suitable for receiving a plurality of cards 14. The latter would typically be a collection of plastic cards, normally carried by an individual. For example, they would include credit card(s); store ID cards; operators' driver's license; and other similar cards either plastic or of rigid or semi-rigid construction. The enclosure volume is slightly larger than the length of the cards 18 and the width of the cards 16, and has a height opening of appropriate dimension to handle the number of cards desired, for example 7. The nominal length and width of the cards typically is 3⅜" by 2⅛", respectively.

The frame member 12 includes a three-sided, perimeter segment 20 which defines a side frame portion. A first and second side, 22, 24, extend parallel to each other in a first direction 25. A third side 26, extends perpendicular to the first and second sides and connects them together at ends 28 and 30. There is no end connecting piece at the distal ends 32, 34 of side segments 22, 24. This provides an open side to the rectangularly shaped enclosure to which a plurality of cards 14 can be inserted into the enclosure for storage until subsequent dispensing by the user.

The frame member 12 further includes an upper frame portion 36. This portion includes a first, top segment 38 and a second top segment 40 which are connected to the contiguous side segments 22 and 24 respectively to provide a rigid structure to the frame member 12, in this embodiment. A third top segment 42 interconnects the respective ends 44 and 46 of first and second top segments 38 and 40 to provide structural rigidity to the device. Alternately, a connecting segment such as segment 42 could be interposed between the first and second sides of the frame member at the lower frame portion to be discussed immediately hereafter.

A lower frame portion 48 includes at least two bottom segments, first segment 50 and second segment 52. These similarly connect to the first and second side segments 22, 24 and can co-extend with their length in the first direction 25.

In the illustrated embodiment, the inner perimeter formed by the first and second top segments 38 and 40 and end side segment 26 and third top segment 42 define an upper opening. The width 54 of the opening is defined by the inboard edges 56 and 58 of top segments 38 and 40. This width, 54, is less than the width 16 of the cards 14. Dimensionally, the width 54 would be less than the 2⅛" wide card.

First and second bottom segments, 50, 52 form a lower opening. The width 60 of the lower opening is measured between the inboard edges 62 and 64 of the bottom segments 50 and 52. This width, 60, is likewise less than the width of the cards 16.

The upper and lower openings are defined as lying in the plane of the respective top or bottom segments which form the opening. Since the width of these respective openings is less than the width of the cards, any cards contained in the enclosure, can not be removed from the device in either the direction 66 or 68, perpendicular to the plane of the upper and/or lower openings.

Figure 2:
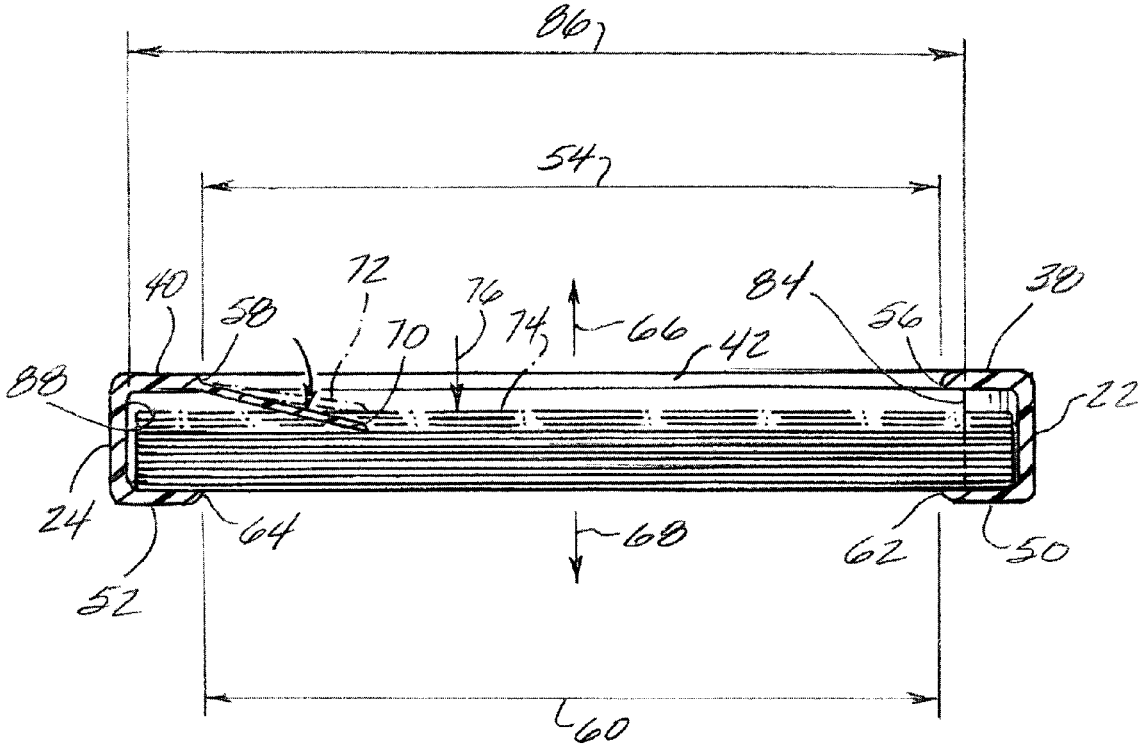
FIG. 2 is a side, sectional elevational view taken along lines 2-2 of FIG. 3.

A tab section 70 is included as part of the second top segment 40. Of course, sections similar to 70 can extend outward from any one or more of the segments, top or bottom, described above. In the embodiment depicted, the tab section 70 extends into the profile of the upper opening. Typically, during the manufacturing process, the tab section is formed so as to be pre-biased downward, as viewed in FIG. 2, into the enclosure volume formed by the frame member 12. As formed during the manufacturing process, the tab section 70 appears as shown in FIG. 2. When cards are inserted into the device, the tab section is urged upward, against the pre-bias, and assumes the position 72, shown in phantom in the FIG. 2 view. In this phantom position, the tab section 70 contacts the upper card 74 and exerts a force in the direction of arrow 76 on the cards stored in the device. This force inhibits the removal or discharge from the device through the open side 78 which provides access to the enclosure volume.

Any portion of the various top or bottom segments used to form the frame member, and/or the tab section 70, can be sized to include a sufficient surface area, for example, 80 on tab section 70, so as to allow and facilitate the placement of suitable indicia, such as a company's logo, using known techniques. This enhances the promotional value of the device. The tab section 70 can be configured in various shapes, for example the trapezoidal shape shown, which can achieve some of the purposes of the invention, namely, providing an adequate surface for placement of appropriate indicia, as well as providing a biasing capability to facilitate the retention of the cards in the device and their access in a manner to be described hereinafter.

In addition to the tab section 70, a card retention tab 82 is formed during manufacturing, so as to extend from first side 22, outward therefrom in the direction of 25. As shown, it forms a quadrant-shaped ending directed inward, into the profile of opening 78, as shown. End 84 of the tab terminates at a distance 86 from the inside surface 88 of side 24. This distance 86 in the embodiment illustrated, is approximately 2 1/16". This is approximately 1/16" less than the width 16 of the plastic cards to be retained in the device. Because of this reduced distance, the cards, once inserted into the device, are precluded from falling out of the device while being handled or carried. The thickness of the material of construction for the device, approximately 1 millimeter, results in the tab having a certain flexibility which allows it to flex at its connection to the side segment 22 so that through the application of force through the user's fingers, cards can be physically removed from the device, as needed, as described below.

Figure 3:
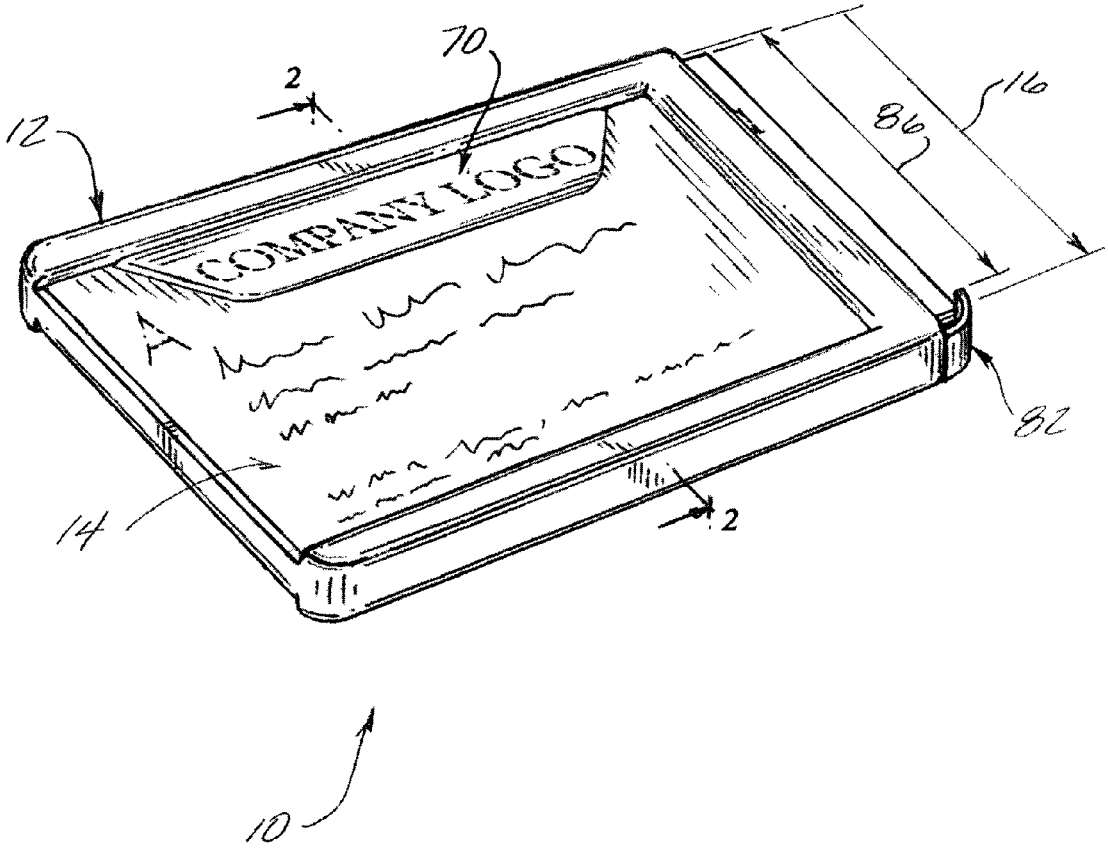
FIG. 3 is a perspective view of the device of the present invention with the cards to be retained already installed in the device.

FIG. 3 shows the device including a plurality of cards, such as plastic credit cards, store identification cards, etc. As described above, the cards are retained in the device 10 during the time they are not required, through the reduced size of the upper and lower openings, the biasing force of tab section 70 and the retention tab 82.

Figure 4:
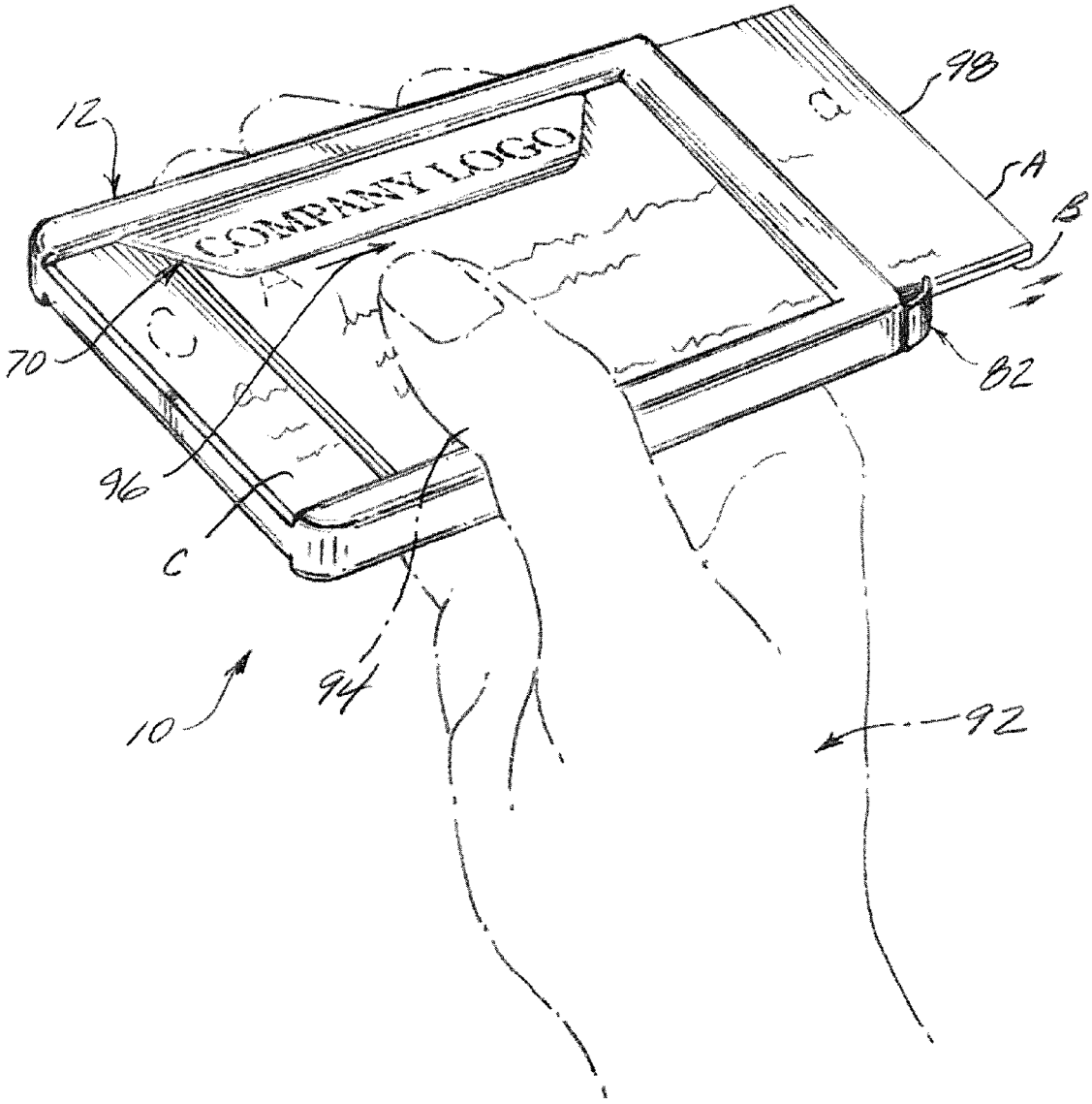
FIGS. 4 and 5 illustrate the one hand operation of the present invention.
Figure 5:
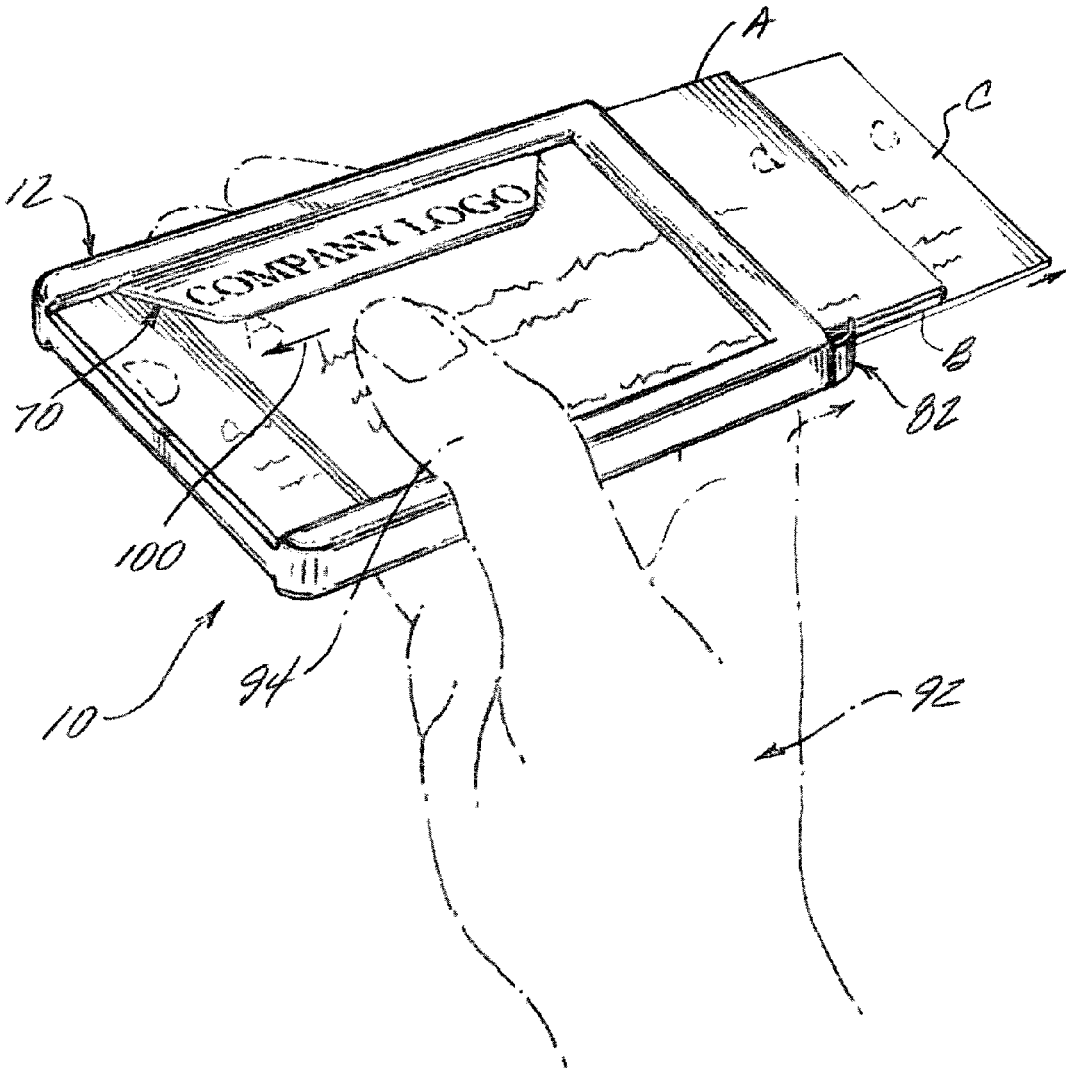

FIG. 4 illustrates the functionality of the card holding device by a user employing only one hand 92. FIGS. 4 and 5 illustrate the functionality of the device and its inherent ability to assist the user in accessing any one of the cards, the number of which, in a typical application could be six or seven.

In the application illustrated in FIG. 4, the user retrieves the device containing the cards either from his pocket or her purse, and manipulates it in order to access a particular card. In the circumstance illustrated in FIG. 4, the user desires to access and remove card "C", the third card down in the stack. The user grasps the device in the palm of his hand and urges cards "A" and "B" to the right, as viewed in that figure, by applying a force through his thumb 94 in the direction of arrow 96. Retention tab 82 and tab section 70 exert respective opposing forces on the stack of cards throughout the procedure. These forces enable the user to work his or her way through the stack of cards until the particular card he desires is visible, again in the illustration, card "C". Through an appropriate amount of force exerted on the cards, the user is able to move the cards to the right as viewed in FIG. 4, again, until the card that is desired, is visible. He moves cards "A" and "B" sufficiently forward to the right so that he is able to place his thumb on card "C" and move it likewise to the right beyond the right edges 98 of cards "A" and "B". Once the card "C" is visible to the right of edges 98, the user then reverses the direction of the force supplied by the thumb, now in the direction of arrow 100. This action returns two top cards "A"

and "B" to the device and enables the user to remove card "C" between his thumb and index finger and provide it to the store attendant. Again, all of this can be accomplished using only the one hand, if circumstances require.

Typically, the device 10 is made from flexible, unbreakable plastic such as polyethylene or some similar material. In a preferred embodiment, the device would hold upwards of seven credit cards. The device is lightweight and has a low profile which permits carrying the device in the pocket or purse without significant inconvenience.

While only one particular and preferred embodiment is described, it should now be apparent to those of skill in the art, how alternate embodiments may implement the purposes of the present invention. As such, the invention can only be construed and limited in its breadth by the scope of the claims that follow.

What is claimed is:

1. A card holder and dispensing device comprising:

(a) a frame member, the frame member arranged in a rectangularly shaped manner thereby forming an enclosure volume, comprising, (i) a three sided perimeter segment defining a side frame portion, two sides of said three sided perimeter segment extending parallel in a same first direction having a first axis and a third side extending perpendicular to and between said two of said sides;

(ii) an upper frame portion having at least three top segments including two parallel top side segments, each of said two parallel top side segments contiguous with a respective one of said two sides of said three sided perimeter segment extending parallel in said same first direction a third top segment perpendicularly connected between respective ends of said two parallel top side segments at an open side to said enclosure volume, said three top side segments forming a part of the perimeter for an upper opening, said upper opening coplanar with said two parallel top side segments said upper opening having an area such that substantially all of the indicia disposed on one side of a card held by said card holder is viewable;

(iii) a lower frame portion having at least two parallel bottom side segments, each of said at least two parallel bottom side segments extending parallel to each other in said same first direction and contiguous with two respective sides of said perimeter segment, said at least two parallel bottom side segments forming a part of the perimeter for a lower opening, said lower opening coplanar with said two parallel bottom side segments, said lower opening having an area such that substantially all of the indicia disposed on one side of a card held by said card holder is viewable; and (b) a substantially planar tab section, said tab section extending from at least one of said top side segments or said third top segment, said tab section having sufficient, upper surface area and contour to permit the placement of predetermined indicia on said upper surface area so as to be visually apparent to a user, said tab section having a bottom surface area, said tab section biased downward into the volume of said enclosure such that said bottom surface area of said tab section will contact the upper most card of a plurality of cards stored in said enclosure, whereby said tab section exerts a force on the cards stored in said enclosure, said force sufficient to inhibit the removal of any one of the cards stored in the device without the application of a force in the direction of said same first direction directed away from said enclosure, said tab section substantially coplanar with said two parallel top side segments when said card holder is filled to capacity with cards, said enclosure volume formed by said rectangularly shaped frame member being accessed by way of said open side remaining in the enclosure formed volume in part by said three sided perimeter segment, whereby a plurality of cards each having a known surface area can be inserted into said enclosure in the direction of said first axis through said open side, to be held for subsequent dispensing from the enclosure, as required, by the user, said upper opening and said lower opening each having a predetermined area less than the known surface area of the cards, such that the cards cannot be removed from the device in a direction perpendicular to a plane of the upper opening or to a plane of the lower opening, said predetermined area of said upper opening substantially identical to the predetermined area of said lower opening, except for the reduction of said predetermined area of the upper opening by said tab section.

2. The device claimed in claim 1 further comprising a card retention tab extending from one of said two of said parallel sides beyond the enclosure formed by the frame member, said card retention tab configured to restrain the removal of a card from the device, said card retention tab further adapted to permit the removal of a card from the enclosure only through the application of a force in the direction of said first direction directed away from said enclosure.

3. The device claimed in claim 1 wherein said tab section is trapezoidally shaped with the longer side of the trapezoidally shaped tab section co-extensive with the one of said top segments from which said tab section extends.

* * * * *